US006151731A

United States Patent [19]

Saparow

[11] Patent Number: 6,151,731

[45] Date of Patent: Nov. 28, 2000

[54] UNIVERSAL DUSTRUFFLE

[76] Inventor: Herschel C. Saparow, 1229 Riversound Ct., Marietta, Ga. 30068-2913

[21] Appl. No.: 09/057,317

[22] Filed: Apr. 9, 1998

Related U.S. Application Data

[60] Provisional application No. 60/077,755, Mar. 12, 1998.

[51] Int. Cl.[7] ..... A47C 21/00

[52] U.S. Cl. ..... 5/493; 5/482

[58] Field of Search ..... 5/482, 486, 493, 5/488, 923, 925

[56] References Cited

U.S. PATENT DOCUMENTS

| | | | |
|---|---|---|---|
| 2,619,658 | 12/1952 | Weinberg | 5/493 |
| 4,796,317 | 1/1989 | Kallman et al. | 5/493 |
| 4,860,398 | 8/1989 | Karpinski | 5/493 |
| 4,897,891 | 2/1990 | Kallman et al. | 5/493 |
| 5,205,003 | 4/1993 | Green | 5/493 |
| 5,271,112 | 12/1993 | Bible et al. | 5/493 |
| 5,285,542 | 2/1994 | West et al. | 5/500 |
| 5,353,456 | 10/1994 | Evans | 5/493 |
| 5,621,931 | 4/1997 | Hamilton | 5/493 |

OTHER PUBLICATIONS

The Quilting Idea Book—Scroll Custom Quilting Catalog (1997).

*Primary Examiner*—Terry Lee Melius
*Assistant Examiner*—James M Hewitt
*Attorney, Agent, or Firm*—Needle & Rosenberg, P.C.

[57] ABSTRACT

A dustruffle for a bed, including one or more panels having a skirt portion which drapes over the boxspring to adjacent the floor, and a shelf portion formed from a non-slip material such as needlepunch. The shelf portion is inserted between the boxspring and mattress of the bed, and the drop of the skirt portion is adjusted by selectively varying the depth of insertion of the shelf portion. The ends of the panels can be folded in a lengthwise direction to conform to the length and width of the particular bed.

11 Claims, 4 Drawing Sheets

UNIVERSAL DUSTRUFFLE

CROSS-REFERENCE TO RELATED APPLICATION

This application claims the benefit of the earlier filing date of co-pending United States Provisional Patent Application Serial No. 60/077,755, filed Mar. 12, 1998, the disclosure of which application is hereby incorporated by reference herein.

BACKGROUND OF THE INVENTION

1. Field of the Invention

This invention relates generally to dustruffles for beds, and more specifically to an improved dustruffle for allowing easy adjustment of the drop of the dustruffle to match the height of the bed, and of the horizontal dimension of the dustruffle to match the length or width of the bed. The dustruffle of the present invention provides a better fit and appearance than previously-known dustruffles, and is easier, faster and less expensive to install, adjust, maintain, repair and/or replace.

2. Description of Related Art

Dustruffles, also referred to as bedskirts, dusters, bed ruffles and bed valences, are often installed about the perimeter of a bed for decorative purposes. A dustruffle will typically be installed to span the distance between the ground and the bed's boxspring or other mattress foundation. The foot and sides of a standard bed, and all four sides of a daybed, are often covered by a dustruffle.

Traditionally, dustruffles have been formed from a flat sheet or platform of material, which was placed between the box spring and the mattress, and a ruffled skirting material permanently attached to the edges of the flat sheet of material and draping over the sides of the boxspring toward the floor. This configuration has been found to present several difficulties. For instance, the placement of the flat sheet between the boxspring and mattress necessitates lifting the entire mattress to remove the dustruffle for cleaning or replacement, or to adjust the position of the dustruffle. Also, the fixed dimensions of the platform and the permanently attached skirting render the traditional dustruffle compatible with only a narrow, limited range of bed component dimensions. In particular, different sizes of dustruffles must be provided for twin, full, queen, king and any other bed sizes. This increases the expense of manufacturing, and requires additional stocking space for retailers and commercial users wishing to maintain a replacement inventory. Moreover, the fixed dimensions of traditional dustruffles present fitting problems, even on beds of the same nominal sizes. For example, two queen-size beds may have substantially different boxspring thicknesses, thereby rendering their "drop," or distance from the top of the boxspring to the floor, different by as much as several inches. Differences in bed frame height, carpet thickness, and the addition or removal of casters on the bed frame may also cause the drop to vary by several inches or more. Thus, a traditional "queen-size" dustruffle may drag on the floor when placed on one queen-size bed, but allow a noticeable gap between the bottom of the skirting and the floor on another queen-size bed. For these reasons, traditional dustruffles often require substantial hand alteration to achieve a correct fit.

Further disadvantages to the traditional dustruffle have been recognized as well. For example, the entire dustruffle must be replaced in the event only a single portion of skirting is damaged. Also, traditional dustruffles having a continuous skirting typically require alteration to provide a corner split when it is desired to use the dustruffle with a bed frame having corner posts at the foot of the bed.

Several previous efforts to improve upon the traditional dustruffle are known. For example, hook-and-loop fasteners such as Velcro, two-sided tape, upholstery pins and other attachment means have been utilized to allow adjustment of the drop of the skirting. None of these has proven fully successful. For example, such dustruffles typically still require the provision of a platform sheet between the boxspring and the mattress, to which the skirting segments are attached by whatever attachment means is chosen. Thus, different bed sizes still require differently sized platform sheets, and removal of the platform sheet requires lifting the entire mattress. In addition, fasteners such as upholstery pins are time consuming to install and remove, and can present choking hazards for children if they become dislodged. Two-sided tape loses its adhesiveness over time, does not permit easy removal of the skirting for laundering or adjustment, and may mar the finish of the bed frame. Hook-and-loop fastening systems are difficult to adjust to the proper height, as the opposed fastener components must be completely disengaged to permit adjustment. Such fastener systems also are incompatible with lengthwise folding of the skirting segments to conform to the dimensions of a particular bed, as folding may cover the fastener or otherwise interfere with its operation. The use of attachment means such as hook-and-loop fasteners or two-sided tape to secure skirting to the bed frame or the boxspring is also undesirably time consuming, as at least two separate steps are required. First, the fastener must be attached to the frame or boxspring, and second, each segment of skirting must be attached to the fastener.

Thus, it can be seen that a need exists for a dustruffle of generally universal application, which is suitable for use with beds of different nominal sizes as well as different drops. A further need exists for such a dustruffle which eliminates the need for a platform sheet, and which can be installed, adjusted, removed and replaced without the need for lifting the entire mattress. A need also exists for such a dustruffle which allows replacement of individual skirting segments. The elimination of fasteners used to secure a dustruffle to a bed frame or boxspring, or to secure skirting to a platform sheet is also desirable. It is to the provision of a method and apparatus meeting these and other needs that the present invention is primarily directed.

SUMMARY OF THE INVENTION

Briefly described, in a preferred form, the present invention generally comprises a dustruffle including a flexible skirt having a first skirt edge and a second skirt edge. The dustruffle also includes a shelf having a first shelf edge and a second shelf edge. The first skirt edge is joined to the first shelf edge, preferably by stitching. The shelf preferably comprises a non-slip material such as needlepunch, which serves to hold the dustruffle securely in place. The skirt may be shirred, tailored, boxpleated, or otherwise aesthetically formed.

In another preferred form, the present invention generally comprises a dustruffle for installation between a mattress foundation and a mattress of a bed, the bed having a head end, a foot end, and first and second sides extending between the head and foot ends. The dustruffle includes at least one panel. Each panel includes a shelf made of a non-slip material such as needlepunch for engagement between the mattress foundation and the mattress, and a skirt attached to said shelf. Multiple panels are preferably provided, depending on the application and the desired appearance. For example, a first panel can be provided for engagement between the mattress foundation and the mattress adjacent the foot end of the bed, a second panel for engagement between the mattress foundation and the mattress adjacent the first side of the bed, and a third panel for engagement between the mattress foundation and the mattress adjacent the second side of the bed. Such an arrangement would be typical for use with a standard bed having a headboard at its head end. For other applications, such as daybeds for example, the dustruffle can also include a fourth panel for engagement between the mattress foundation and the mattress adjacent the head end of the bed.

In another preferred form, the present invention generally comprises a method of installing a dustruffle on a bed. The method preferably entails inserting a non-slip shelf portion of a dustruffle panel to a depth of insertion between a mattress foundation and a mattress of a bed, and adjusting the drop of a skirt portion of the dustruffle panel by selectively varying the depth of insertion of the shelf portion between the mattress foundation and the mattress. More preferably, the method entails installing first, second and third dustruffle panels adjacent a foot end of the bed, a first side of the bed and a second side of the bed, respectively, wherein each of the first, second and third dustruffle panels is installed according to the above-described inserting step and adjusting step. For other applications, such as daybeds for example, the method can further include installing a fourth dustruffle panel adjacent the head end of the bed according to the above-described inserting step and adjusting step. The method of the present invention can also include folding a section of a dustruffle panel upon itself in a lengthwise direction to conform to a dimension of the bed.

These and other features and advantages of the present invention will become apparent upon reading the following description in conjunction with the accompanying drawing figures.

DETAILED DESCRIPTION

Figure 1:
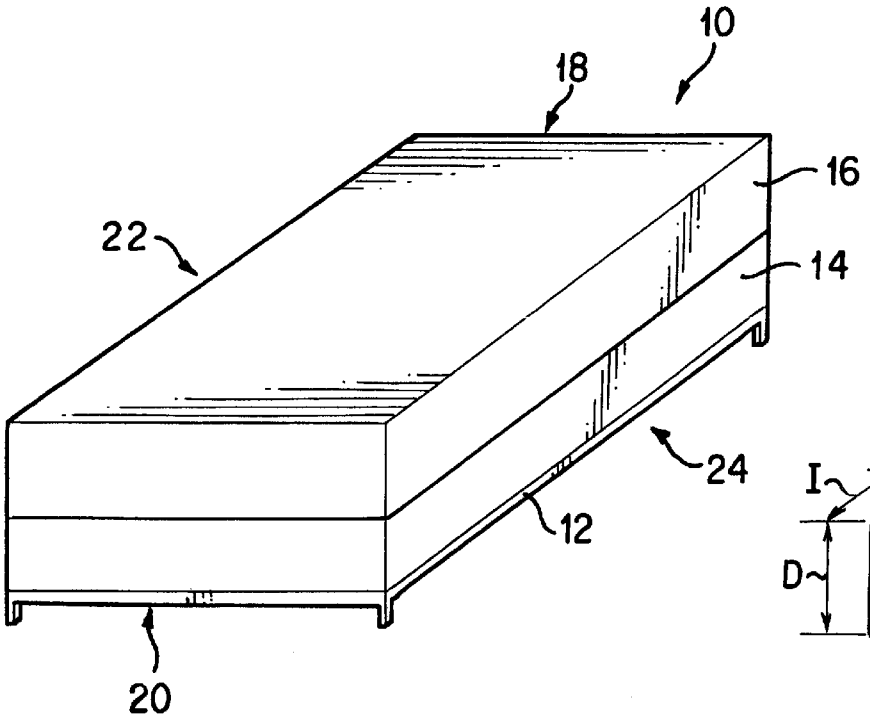
FIG. 1 is a perspective view of a bed, including a bed frame, a boxspring and a mattress.

Referring now in detail to the drawing figures, wherein like reference numerals represent like parts throughout, FIG. 1 shows a bed 10, of standard known design. The bed 10 generally comprises a bed frame 12, a boxspring or other mattress foundation 14, and a mattress 16. The bed is depicted as rectangular, having a head end 18, a foot end 20, a first side 22, and a second side 24. It will be understood by those of ordinary skill in the art, however, that the present invention is equally applicable to use with beds of other shapes. It will also be understood that the present invention is applicable to use with beds of standard sizes (i.e., twin, full, queen, king, California king), irregular sizes, and different configurations, such as daybeds.

Figure 2:
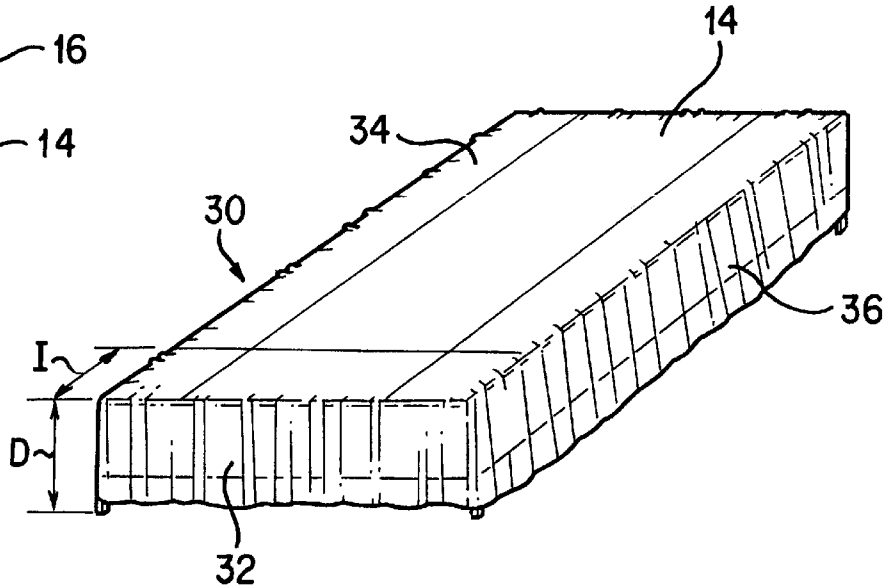
FIG. 2 is a perspective view of a dustruffle, installed on a bed over the boxspring.

FIG. 2 shows a dustruffle 30 installed on a portion of a bed, draped over the boxspring 14. As shown, the dustruffle 30 generally comprises three separate panels: a first panel 32 adjacent the foot end 20 of the bed 10; a second panel 34 adjacent the first side 22 of the bed 10; and a third panel 36 adjacent the second side 24 of the bed 10. A fourth panel (unshown) can also be provided adjacent the head end 18 of the bed 10, if desired. Typically, the provision of a fourth panel will be unnecessary for standard beds including a headboard, or bed which are placed with the head end 18 against a wall or other structure. The provision of a fourth panel will generally be desirable for daybeds, and other beds having all four sides exposed. Fewer or more panels may be required for beds of shapes other than rectangular. Although the depicted embodiment comprises separate panels for installation on the respective sides and ends of the bed 10, it will be understood that the present invention also comprehends the provision of a single panel which may be installed to span two or more sides of the bed. Separate panels are preferred, however, as a natural corner split is thereby provided, allowing clearance for cornerposts of the bed frame. Separate panels also allow easier adjustment of the drop, and enable the removal of a single panel for cleaning, repair or replacement, without disturbing other panels.

Figure 3C:
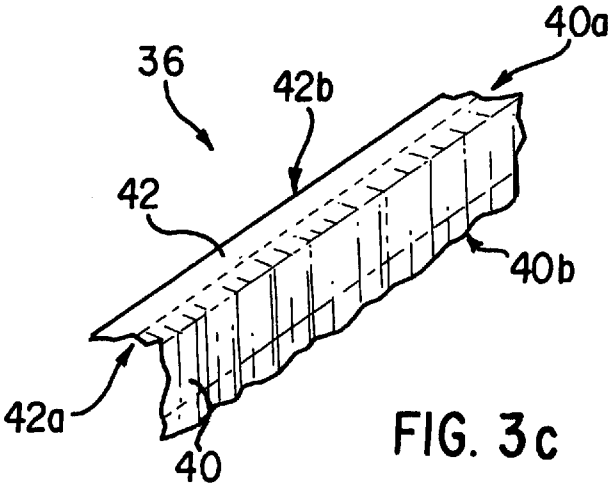
FIG. 3*c* is a perspective view of another panel of the dustruffle shown in FIG. 2.
Figure 3B:
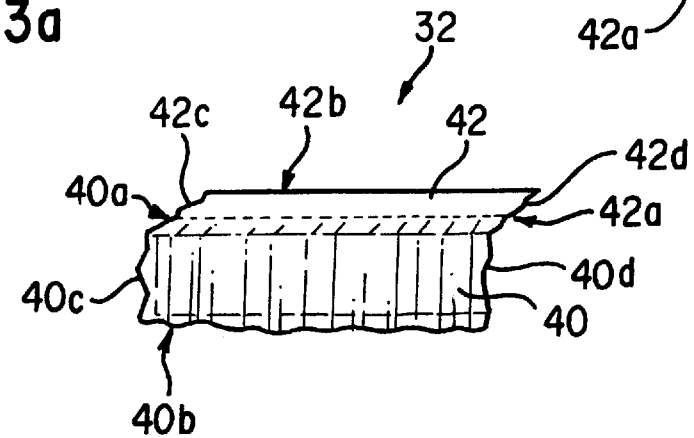
FIG. 3*b* is a perspective view of another panel of the dustruffle shown in FIG. 2.
Figure 3A:
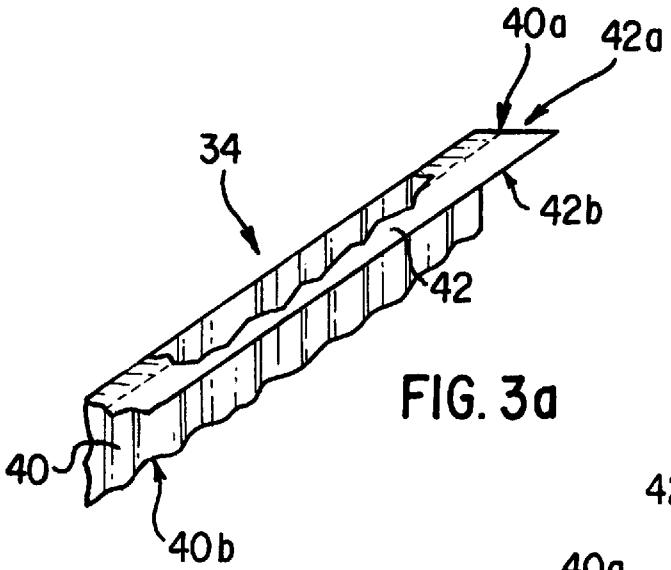
FIG. 3*a* is a perspective view of a panel of the dustruffle shown in FIG. 2.
Figure 4B:
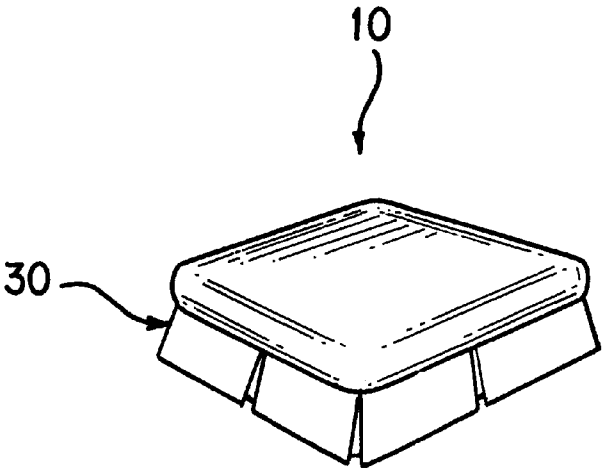
FIG. 4*b* is a perspective view of a bed with a dustruffle installed and having a tailored skirt portion.
Figure 4C:
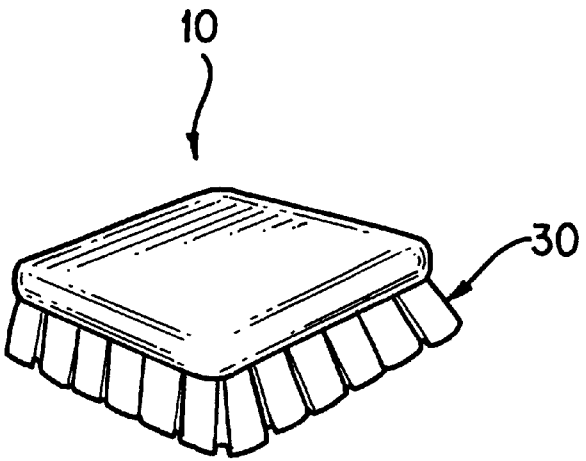
FIG. 4*c* is a perspective view of a bed with a dustruffle installed and having a box pleated skirt portion.
Figure 4A:
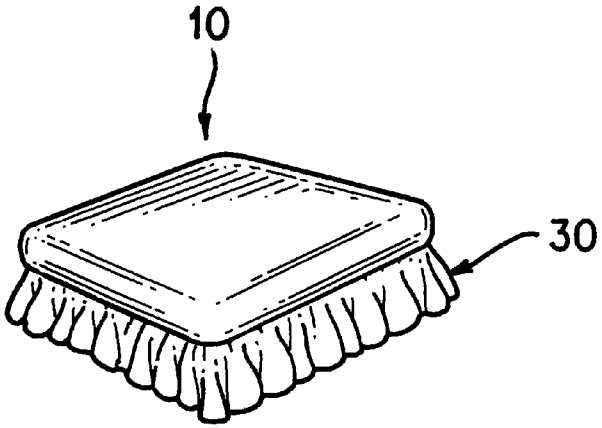
FIG. 4*a* is a perspective view of a bed with a dustruffle installed and having a shirred skirt portion.

Each panel of the dustruffle 30 of the present invention is shown in preferred form in FIGS. 3*a*–3*c*. The first panel 32 is shown in FIG. 3*b*, the second panel 34 in FIG. 3*a*, and the third panel 36 in FIG. 3*c*. Each panel is of generally similar construction, comprising a flexible skirt portion 40 and a shelf portion 42. The skirt 40 is preferably an elongate, generally rectangular section of fabric having a first skirt edge 40*a* and a second skirt edge 40*b*, and a first skirt end 40*c* and a second skirt end 40*d*. The skirt 40 is preferably formed from an aesthetically appealing material, and may be formed into a shirred (gathered) (see FIG. 4*a*), tailored (see FIG. 4*b*), boxpleated (see FIG. 4*c*), or other decorative configuration. The second skirt edge 40*b*, and both ends 40*c*, 40*d* are preferably hemmed to prevent unraveling of the fabric, and to provide a finished appearance. Example materials of construction from which the skirt 40 can be fabricated include cotton, polyester, silk, velvet, linen, and other fabrics. The width of the skirt 40, between the first skirt edge 40*a* and the second skirt edge 40*b*, preferably is at least approximately equal to the height above the floor of the top of the highest mattress foundation upon which the dustruffle may be applied. The skirt 40 may be provided with decorative treatments such as quilting, and/or functional treatments such as flame-retardants or wrinkle-retardants.

Figure 5:
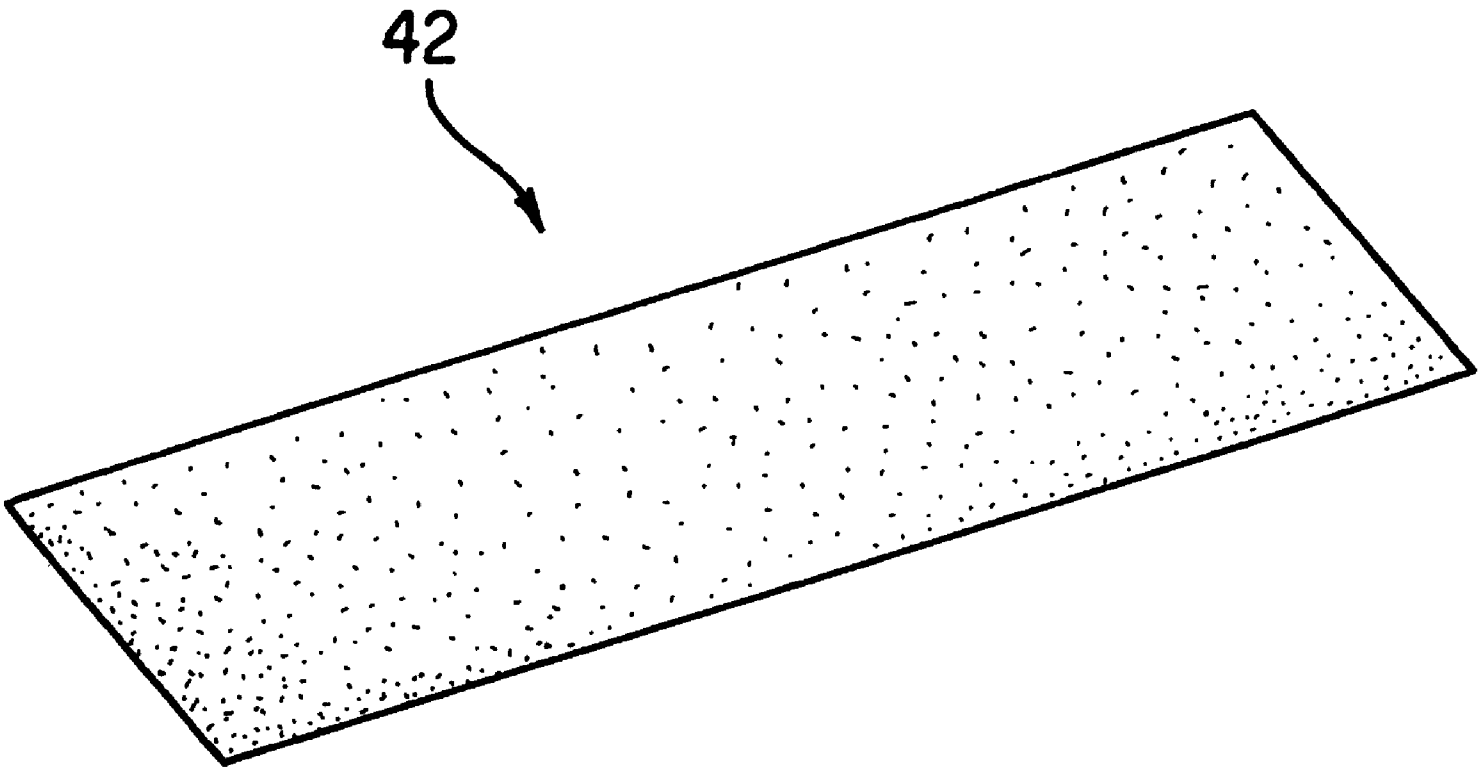
FIG. 5 is a perspective view of a section of needlepunch material.

The shelf 42 of each panel of the dustruffle 30 of the present invention is preferably an elongate, generally rectangular section of fibrous fabric, having a first shelf edge 42*a* and a second shelf edge 42*b*, and a first shelf end 42*c* and a second shelf end 42*d*. The first shelf edge 42*a* is joined to the first skirt edge 40*a*, by attachment means such as stitching or adhesive. The second shelf edge 42*b*, and both ends 42*c*, 42*d* can be hemmed. The shelf 42 preferably is fabricated from needlepunch (see FIG. 5) or an equivalent material, the fibrous surface texture of which serves to frictionally engage the boxspring and mattress surfaces between which the shelf is placed when in use, thereby resisting displacement. Needlepunch is a compressed polyester fiber material, and is commercially available from suppliers including Kasbar National Industries, Inc., of Broomall, Pa.; and Bonded Fibers, Inc. of California. Generally described, needlepunch is a polyester fiber which is pounded with needles until it attains a flat, flannel-like appearance. The preferred weight of needlepunch material used to construct the shelf is 4.2 oz. for a one yard long by 135" wide section. Needlepunch has been found to provide a number of desirable attributes, including: a gripping surface texture which frictionally adheres to the mattress and/or boxspring without the need for adhesives, pins, Velcro, or other fasteners; inherent flame retardance; easy care; and low cost. In an alternate embodiment, the skirt portion 40 and the shelf portion 42 comprise a unitary panel component, and the shelf portion 42 is provided on at least one side with a non-slip surface such as needlepunch or an equivalent material.

Method of Use

The present invention also comprises a method of installing a dustruffle, substantially as described above, on a bed. The method of the present invention preferably comprises inserting the shelf portion of a dustruffle panel to a depth of insertion, designated as I in FIG. 2, between the boxspring or other mattress foundation and the mattress of a bed. This may require raising portions of the mattress to insert the shelf portion, but generally will not require lifting the entire mattress. The method further comprises adjusting the drop, designated as D in FIG. 2, of the skirt portion of the dustruffle panel. This is preferably accomplished by selectively varying the depth of insertion I of the shelf portion between the mattress foundation and mattress. The drop D is preferably adjusted so that the second skirt edge 40*b* is in close proximity to the floor. The weight of the mattress bears on the shelf portion of the dustruffle panel, thereby resisting displacement of the skirt portion out of adjustment, due to the frictional engagement of the shelf portion of the dustruffle panel with the top surface of the boxspring and the bottom surface of the mattress. The provision of separate dustruffle panels permits adjustment and removal of a single panel without disturbing other panels.

In a further preferred form, the method of the present invention comprises installing multiple dustruffle panels on a bed. For example, first, second and third dustruffle panels, substantially as described above, can be installed at the foot end, the first side and the second side of a bed. If desired, a fourth dustruffle panel can be installed on the head end of the bed. The installation of each panel will generally follow the above-described steps of inserting the shelf portion of the dustruffle panel to a depth of insertion between the mattress foundation and mattress of a bed, and adjusting the drop of the skirt portion by selectively varying the depth of insertion of the shelf portion between the mattress foundation and mattress.

The method of the present invention can also include folding a section of one or more dustruffle panels upon themselves in a lengthwise direction to conform to a dimension of the bed. For example, either or both ends of the first panel (and the fourth panel, if present) can be folded under the remainder of the panel to generally match the width of the bed. Similarly, either or both ends of the second and/or third panels can be folded under the remainder of the panel to generally match the length of the bed.

Because the present invention enables both drop adjustment and adjustment of the dustruffle panel length to match the bed dimensions, the dustruffle panels can be standardized, thereby reducing manufacturing costs and stocking requirements. For example, a small number of standard sized dustruffle panels may be provided to accommodate virtually any standard or non-standard bed size. Alternatively, continuous lengths or rolls of dustruffle material, including the skirt and shelf portions as described above, can be produced. These continuous lengths can then be cut to the desired panel length, hemmed on the sides if desired, and installed according to the above-described methods. These advantages of the present invention will permit manufacturers, sellers and users of dustruffles to achieve greater efficiencies of operation. For example, manufacturing efficiency may be increased by reducing the number of standard sizes which must be produced, allowing more continuous production runs and/or minimizing the difficulty of producing a custom fit. Sales efficiency may be improved due to reduced shelf space requirements brought about by eliminating the need for different sizes of dustruffles for differently sized beds. Users of dustruffles, and in particular, commercial lodging establishments in the hospitality industry, will benefit from reduced labor expenses from more easy installation, adjustment, removal, cleaning, repair and replacement, as well as from reduced stocking and reordering requirements.

In addition to the above-described advantages and features, the dustruffle and method of installation of the present invention permit application of a dustruffle to beds which would otherwise likely require the provision of expensive, custom-made dustruffles. Irregular bed structures may be encountered for a variety of reasons. For example, persons having physical handicaps may find it easier to get in and out of a bed which is sloped to some extent, relative to the floor. In addition, it is not uncommon for a bed to sag in one or more places due to repeated use. For example, a person may repeatedly sit on one particular corner of a bed to dress or tie their shoes, flattening that corner of the bed somewhat, and resulting in an uneven bed. In such cases, the drop of the bed may not be constant across the bed's width and/or length. Traditional dustruffles require custom fitting to accommodate such a bed configuration. The present invention, by contrast, allows easy and inexpensive adjustment of the dustruffle to match the bed's drop at all points along the length and/or width of the dustruffle, simply by appropriate control of the depth of insertion of the shelf portion between the mattress and box spring along the respective length and/or width of the bed.

Although the invention has been described according to its preferred embodiments, it will be readily apparent to those skilled in the art that many additions, modifications and deletions may be made without departing from the spirit and scope of the invention, as defined in the following claims.

What is claimed is:

1. A dustruffle for a bed, the bed having a mattress and a mattress foundation, the bed further having a head end, a foot end, and first and second sides extending between the head and foot ends, the head end and foot end defining a bed length therebetween, and the first and second sides defining a bed width therebetween, the dustruffle comprising:

at least one panel, said at least one panel comprising a shelf portion consisting of a unitary section of needlepunch for engagement between the mattress foundation and the mattress, the shelf portion having a first shelf edge and a second shelf edge defining a shelf length therebetween, and said at least one panel further comprising a skirt portion fixedly attached to said shelf portion.

2. The dustruffle of claim 1, wherein said skirt portion is shirred.

3. The dustruffle of claim 1, wherein said skirt portion is tailored.

4. The dustruffle of claim 1, wherein said skirt portion is boxpleated.

5. The dustruffle of claim 1, comprising a first panel for engagement between the mattress foundation and the mattress adjacent the foot end, a second panel for engagement between the mattress foundation and the mattress adjacent the first side, and a third panel for engagement between the mattress foundation and the mattress adjacent the second side.

6. The dustruffle of claim 5, comprising a fourth panel for engagement between the mattress foundation and the mattress adjacent the head end.

7. A method of installing a dustruffle, said method comprising the steps of:

(a) inserting a shelf portion of a dustruffle panel between a mattress foundation and a mattress of a bed, the shelf portion being fixedly attached to a skirt portion of the dustruffle panel and consisting of a unitary section of needlepunch, the bed having a head end, a foot end, and first and second sides extending between the head and foot ends, the head end and foot end defining a bed length therebetween, and the first and second sides defining a bed width therebetween, the mattress foundation being supported at a distance above a floor; and (b) adjusting the shelf portion of the dustruffle panel so that the dustruffle panel extends substantially the distance between the floor and the mattress foundation.

8. The method of claim 7, comprising installing first, second and third dustruffle panels adjacent the foot end of the bed, the first side of the bed and the second side of the bed, respectively; wherein each of said first, second and third dustruffle panels is installed according to said inserting step and said adjusting step.

9. The method of claim 8, further comprising installing a fourth dustruffle panel adjacent the head end of the bed according to said inserting step and said adjusting step.

10. The method of claim 7, further comprising folding a section of the dustruffle panel upon itself in a lengthwise direction to conform to the bed length.

11. The method of claim 7, further comprising folding a section of the dustruffle panel upon itself in a lengthwise direction to conform to the bed width.

* * * * *